United States Patent [19]

Petty et al.

[11] Patent Number: 4,934,870

[45] Date of Patent: Jun. 19, 1990

[54] PRODUCTION PLATFORM USING A DAMPER-TENSIONER

[75] Inventors: Terry D. Petty, Kenner; Luc G. Chabot, La Place; William H. Rehmann, Jr., Slidell, all of La.

[73] Assignee: Odeco, Inc., New Orleans, La.

[21] Appl. No.: 329,165

[22] Filed: Mar. 27, 1989

[51] Int. Cl.[5] ..... B63B 21/50

[52] U.S. Cl. ..... 405/199; 405/195; 405/224; 166/355; 188/164; 188/44; 188/82.3; 188/305; 188/311; 254/29 A; 29/452

[58] Field of Search ..... 405/199, 195, 224; 166/355; 188/67, 1.11, 43, 44, 82.1, 82.3, 267, 164, 297, 305, 311, 180; 254/29 A, 93 R; 29/452

[56] References Cited

U.S. PATENT DOCUMENTS

| | | | |
|---|---|---|---|
| 3,396,945 | 8/1968 | Schreier et al. | 405/199 X |
| 4,167,147 | 9/1979 | Bergman | 114/122 |
| 4,215,950 | 8/1980 | Stevenson | 405/195 |
| 4,305,485 | 12/1981 | Dubreucq | 188/164 |
| 4,367,981 | 1/1983 | Shapiro | 166/355 X |
| 4,379,657 | 4/1983 | Widiner et al. | 405/195 |
| 4,395,160 | 7/1983 | de Jong | 405/195 |
| 4,449,854 | 5/1984 | Nayler | 166/355 X |
| 4,576,520 | 3/1986 | Suh et al. | 405/195 X |
| 4,616,708 | 10/1986 | da Mota | 166/355 |
| 4,617,998 | 10/1986 | Langner | 166/355 X |
| 4,626,136 | 12/1986 | Gunderson | 405/195 X |
| 4,733,991 | 3/1988 | Myers | 405/195 |

*Primary Examiner*—Dennis L. Taylor
*Assistant Examiner*—J. Russell McBee
*Attorney, Agent, or Firm*—Michael P. Breston

[57] ABSTRACT

The floating structure has limited heave oscillations. A long member has a lower end coupled to the seabed. An extensible tensioner is coupled between a platform deck and the upper end of the long member. The tensioner suspends the upper end of said long member and applies a predetermined tension thereto. The tensioner includes anti-heave force-exerting means for exerting downward-acting forces on the floating structure.

24 Claims, 4 Drawing Sheets

PRODUCTION PLATFORM USING A DAMPER-TENSIONER

BACKGROUND OF THE INVENTION

This application is related to copending patent application Ser. No. 07/314,747, filed on Feb. 24, 1989, and assigned to the same assignee.

1. Field of the Invention

The present invention relates generally to floating structures and, more particularly, to oil-and-gas drilling and production platforms using onboard tensioners for tensioning production risers, which extend offshore wells to wellheads on the platforms.

2. Description of the Prior Art

A platform is effectively a spring mass system and as such has a resonant (natural) frequency $F_n$ or period $T_n=1/F_n$ and is subject to resonant oscillatory motion in response to wave action in the seaway. Resonant motion occurs when the natural period of heave is substantially equal to the period of the wave which induces such heave in the platform.

The patent literature describes various structures and arrangements for dynamically and passively damping a floating platform, but these usually require design changes to the platform itself, and/or the use of special devices for achieving the desired damping.

For example, Bergman's U.S. Pat. No. 4,167,147 describes a floating structure having a variety of arrangements for producing velocity damping, i.e., anti-heave forces that are proportional to the heave velocity of the structure.

Bergman's damping system is intended to exert anti-heave forces as the vessel heaves up and also as the vessel heave down. These anti-heave forces are exerted on the structure in a direction opposite to its vertical motion; they are much smaller than the actual wave forces which produce the heave; and they provide a most effective decrease in heave amplitude, especially when the platform is about to approach resonance.

Bergman illustrates in FIG. 14 a passive, damping system which requires a tensioned flexible cable the lower end of which is anchored to a weight on the sea floor, and its upper end passes over a sheave and is fixedly secured to the platform's upper deck. Also on the upper deck is a hydraulic cylinder whose piston rod supports the sheave. The cylinder is filled with pressurized oil below the piston. A restrictive orifice is interposed in the pipe between an oil reservoir and the cylinder to restrict the oil flow between the cylinder and the reservoir.

A deep-floating production platform, which produces oil through wellheads suspended above the waterline, must make use of one production riser for each suspended wellhead. Each riser tensioner system comprises at least one hydraulic cylinder, and a pneumatic-hydraulic source for supplying pressurized fluid to the cylinder. The cylinder is extensibly coupled between a deck and a guide ring which is pivotably anchored to the upper end of the production riser.

This tensioner system is designed to maintain a predetermined minimum, nearly constant tension in the production riser despite relative vertical movement between the floating platform and the guide ring in response to oscillatory wave action on the platform.

It is an object of the present invention to prevent excessive platform resonant heave by modifying the already existing riser tensioner system so that it can generate and apply a downward-acting, anti-heave force to the platform, without interfering with the tensioner's ability to maintain the predetermined minimum tension sufficient to prevent buckling in the production riser, while continuous fluid production takes place from the well through the riser and its associated wellhead tree.

These downward-acting, anti-heave forces can be generated using hydraulic, mechanical, and/or electrical damping means, which maintain, within acceptable limits, the resonant heave response of the platform to wave energy exceeding the expected maximum wave period.

SUMMARY OF THE INVENTION

The damped floating structure has a deck and is free to have limited heave oscillations. A long member has a lower end coupled to the seabed. Coupling means are pivotably secured to the upper end of the long member. An extensible damper-tensioner means is coupled between the deck and the coupling means.

The damper-tensioner suspends the coupling means and applies a predetermined tension thereto. The damper-tensioner includes anti-heave damping means for exerting damping forces on the floating structure, preferably only when the structure heaves up, thereby exerting downward-acting damping forces on the floating structure. The damping means becomes inactive when the structure heaves down.

The floating structure is typically a hydrocarbon production platform, the long member is a production riser, and the coupling means is a guide ring. The extensible damper-tensioner includes a hydraulic cylinder, which has a reciprocating piston rod, and a pneumatic-hydraulic source for feeding and receiving pressurized fluid to and from the cylinder depending on the platform heave oscillations.

A first conduit is coupled between the source and the cylinder. A throttling orifice is in the first conduit. The orifice throttles the fluid flow therethrough as a function of a parameter of the platform heave oscillation.

A second conduit is in parallel with the first conduit. A normally-closed, one-way-acting check valve is in the second conduit. The check valve is closed during a portion of the stroke of the piston rod, and it is open during another portion of the stroke to permit unrestricted fluid outflow from the source to the cylinder, thereby by-passing the orifice. The check valve opens only when the cylinder retracts, i.e., when the platform heaves down.

In some of the embodiments, the damping forces have amplitudes which vary with a parameter of the motion of the cylinder. The parameter is the velocity of the cylinder.

In an alternate embodiment, instead of an orifice, a hydraulic motor is in the first conduit and is operable by the fluid flow through the first conduit. The hydraulic motor drives a suitable load, such as a water pump, etc.

A second conduit with a check valve is in parallel with the first conduit. The check valve opens as in the orifice embodiment.

A third conduit can be provided in parallel with the first and second conduits. A normally-closed control valve is in the third conduit.

When the control valve is opened, the orifice (or the hydraulic motor) together with the check valve become inactive.

In yet another embodiment, at least one rail on the platform is movable therewith relative to the guide ring. The rail preferably has an I-shape in section. A carriage extends radially outwardly from the guide ring. The carriage carries sets of wheels which ride on the web and the flanges of the rail, thereby restricting the tendency of guide ring to rotate and/or to displace laterally.

Motion slowing down means, operatively associated between the guide ring and the rail, are designed to impede the vertical displacements of the rail relative to the guide ring.

The motion slowing down means can be hydraulic brakes, preferably linear friction brakes, for slowing down by friction the upward rail motion.

The motion slowing down means can be linear eddy current brakes.

The linear hydraulic or eddy current brakes are under the control of sensors and instrumentation control modules.

Preferably, only when the platform heaves-up, will the braking action of the linear brakes produce, by friction or electro-magnetically, downward-acting damping forces on the platform.

When the platform heaves-down, the braking action of the brakes is deactivated.

BRIEF DESCRIPTION OF THE DRAWINGS

FIGS. 3 and 3*a* are schematic side elevation views of the novel embodiments of the damper-tensioner system in which the pneumatic-hydraulic circuit, coupling the reservoir and the hydraulic cylinder, includes various combinations of flow control elements for generating the anti-heave damping forces;

DESCRIPTION OF PREFERRED EMBODIMENTS

Many different types of semi-submersible structures are known and presently employed for hydrocarbon drilling and/or production, and principles of the present invention are applicable to many of these, and also to floating structures of other types. Such structures are subject to resonant heave in a seaway.

The invention will be better understood after a brief description of applicant's prior platform and tensioner.

Applicant's Prior Low-Heave Platform

Figure 1:
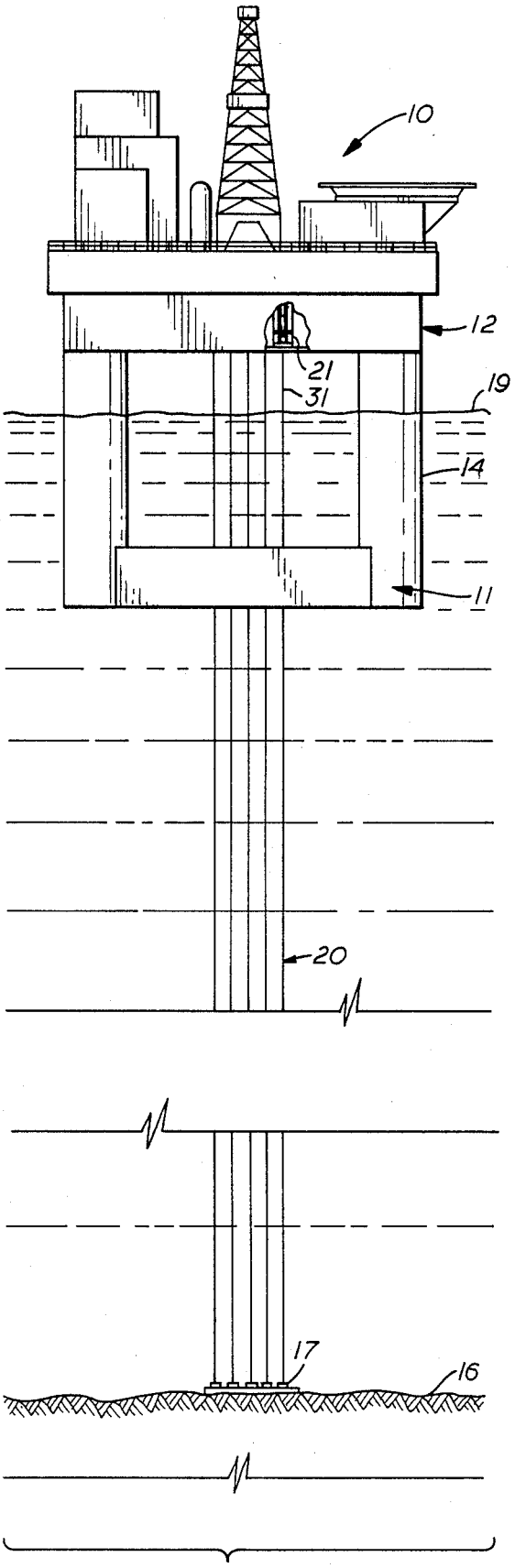
FIG. 1 is a schematic side elevation view illustrating applicants' prior semi-submersible floating platform in position for operation and in which the damper-tensioner system of the present invention can be employed.

The low-heave, column-stabilized, deep-drafted, floating, production platform 10 (FIG. 1) is described in copending application Ser. No. 07/239,813, filed Sept. 3, 1988, and now U.S. Pat. No. 4,850,744. Platform 10 has a fully-submersible lower hull 11, and an above-water, upper hull 12, which has an upper wellhead deck 13. Lower hull 11 together with large cross-section, hollow, buoyant, stabilizing, vertical columns 14 support, at an elevation above the maximum expected wave crests, the entire weight of upper hull 12 and its maximum deck load.

In use, platform 10 is moored on the production location by a spread-type mooring system (not shown), which is adapted to resist primarily horizontal motion of the platform.

Platform 10 is especially useful in a design seaway for conducting hydrocarbon production operations in relatively deep waters over a seabed site 16 which contains submerged oil and/or gas producing wells 17.

Figure 2:
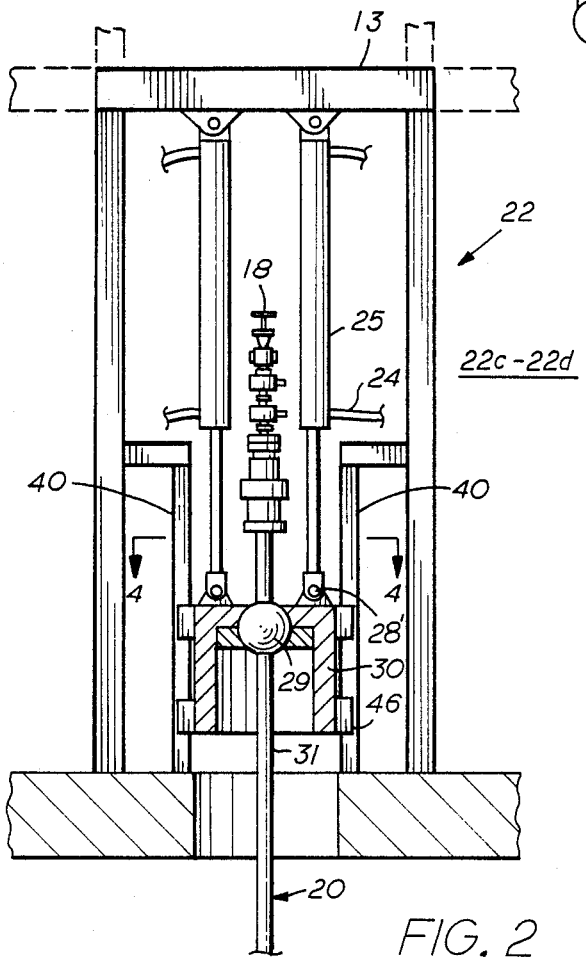
FIG. 2 is a schematic side elevation view, partly in section, of the novel embodiments of the damper-tensioner system which use linear brakes and guide rails for producing anti-heave damping forces.
Figure 4:
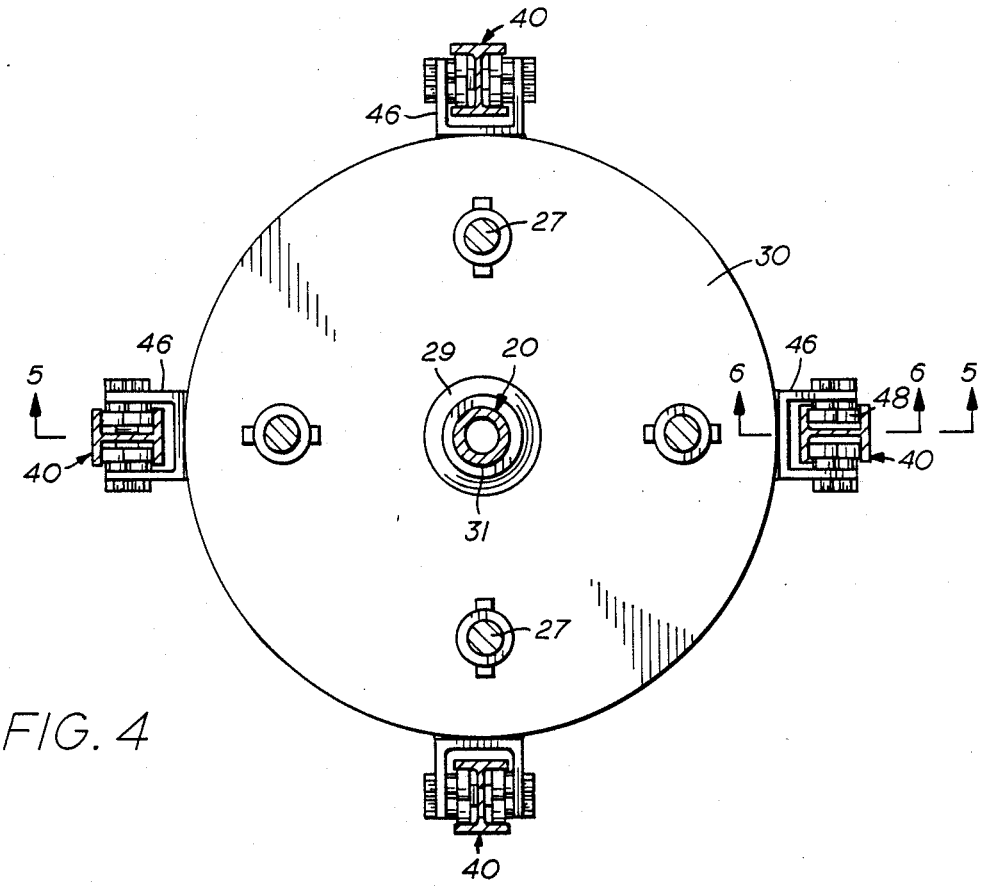
FIG. 4 is a sectional view taken on line 4—4 of FIG. 2.
Figure 5:
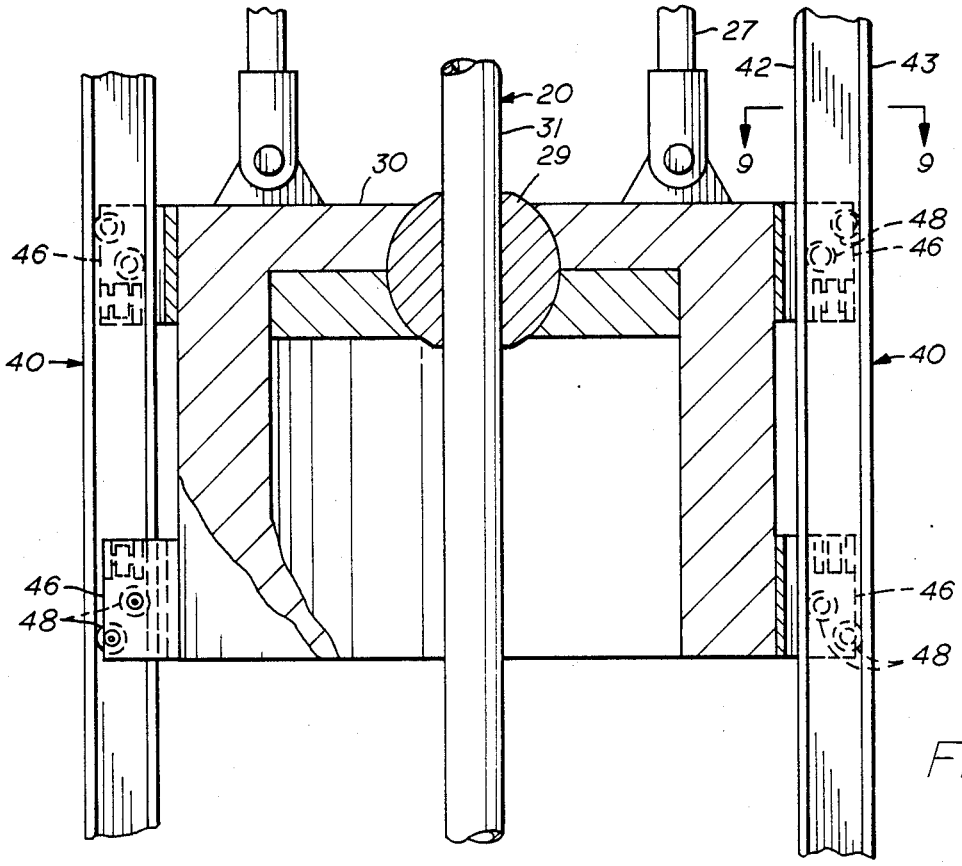
FIGS. 5-6 are partly sectional views, respectively taken on lines 5—5 and 6—6 of FIG. 4.
Figure 6:
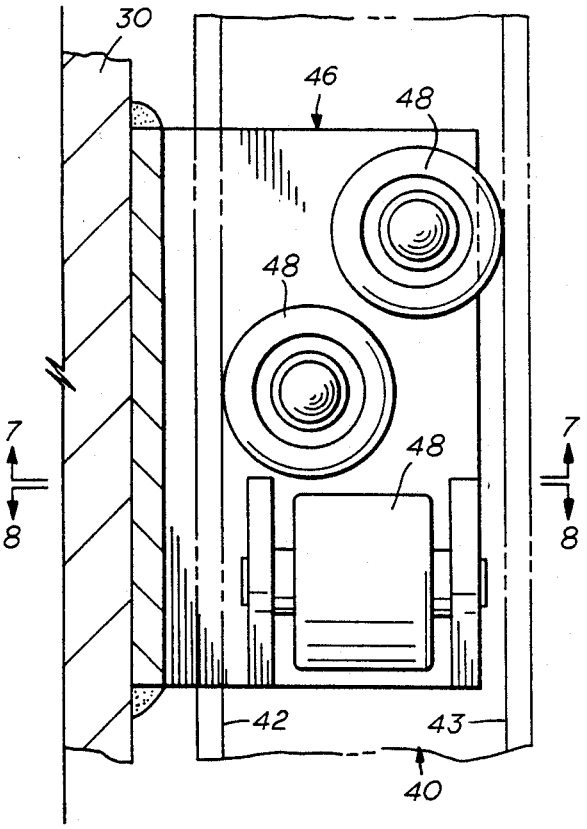

By virtue of the platform's relatively low-heave response in the design seaway, risers 20 and surface-type, production wellhead trees 18 (FIG. 2) can be suspended from wellhead deck 13 above waterline 19. Each wellhead tree 18 is coupled to an individual well 17 through the stiff metal pipe, or production riser 20.

The lower end of riser 20 is tied to a submerged well 17 in seabed 16. Wellhead trees 18 include valves for controlling the fluid flow through risers 20.

Applicant's Prior Tensioner

Each individual riser 20 (FIGS. 1-3) is suspended above water line 19 from a riser tensioner system 21, which comprises one or more, usually four, individual riser tensioners 22.

Pneumatic-hydraulic tensioners are the most commonly used, for example, Model PT400-60, sold by Paul Monroe Co., of Orange Calif. 92668. Also, such tensioners are well described in U.S. Pat. Nos. 4,733,991, 4,379,657 and 4,215,950.

Each tensioner 22 comprises a pneumatic-hydraulic source or reservoir 23 for supplying through a pipe 24 pressurized hydraulic fluid to a hydraulically-operated movable member, typically a hydraulic cylinder 25, having a power piston 26 and a movable piston rod 27. Pipe 24 connects the bottom of hydraulic reservoir 23 with the bottom of cylinder 25 at the rod side thereof.

Each cylinder 25 is pivotably coupled to wellhead deck 13 by a pivot 28. Piston rod 27 extends downwardly and inwardly and is pivotably connected by a pivot 28' to a coupling member, such as a guide ring 30, which is pivotably secured to the upper end 31 of riser 20 by a spherical anchor pivot 29. In use, there should be no relative axial motion between riser 20, wellhead 18, and guide ring 30.

As platform 10 cyclically heaves up and down during each oscillatory cycle, hydraulic fluid is alternately pushed through pipe 24 in and out of cylinder 25, and out of and into reservoir 23. In so doing, the air pressure above the hydraulic fluid in reservoir 23 remains nearly constant due to the large volume of reservoir 23, which allows cylinder 25 to continually support the weight of riser 20 and its wellhead tree 18.

Conventionally, two pairs of such tensioners 22 are located on diametrically-opposite sides of guide ring 30, and each pair operates at identical fluid pressures to prevent uneven riser loading.

For any position of piston 26 along its stroke, piston-rod 27 will apply, through guide ring 30, a continuous, predetermined, large, substantially-constant, upward-acting force F (FIG. 3) for tensioning riser 20.

This force induces a predetermined tension $T_o$ at the top of riser 20, regardless of the displacements and velocity of piston-rod 27. The amplitude of tension $T_o$ should be sufficient to maintain positive tension along the entire length of riser 20, thereby to protect riser 20 against buckling in the design seaway.

When platform 10 sustains oscillatory heave motion in response to wave actions, piston 26 reciprocates in cylinder 25. Each piston 26 has a fixed stroke range calculated to compensate for the maximum expected heave of platform 10 in the design seaway, i.e., the maximum relative vertical displacement between platform 10 and guide ring 30.

Damper-Tensioner of the Invention

To facilitate the understanding of the damper-tensioner of the present invention and to avoid repetitive description, the same numerals will be used, whenever possible, as in tensioner system 21, to designate the same parts. Similar parts may be designated with the same reference characters followed by a letter or prime (′) to indicate similarity of construction and/or function.

The novel damper-tensioner will be shown in four embodiments 22A–22D, which vary in their ability to produce the desired downward-acting, damping forces on platform 10.

No upward-acting damping forces are produced and therefore none are applied to platform 10.

First Embodiment 22A

Damper-tensioner 22A (FIG. 2) comprises a damping means 32 within first pipe 24, such as throttling orifice 32A.

When platform 10 heaves up during each cycle of platform oscillation, piston 26 strokes out, thereby pushing hydraulic fluid out of cylinder 25 and into reservoir 23 through pipe 24 wherein it will be throttled by its orifice 32A.

Accordingly, orifice 32A will generate a downward-acting damping force on platform 10 when it heaves up.

If damping means 32 had only an orifice 32A, then it would also generate an upward-acting damping force on platform 10 when it heaves down, thereby permitting the risers tension to decrease. In this case, $T_o$ must always have a value at least large enough to prevent riser buckling despite the reduction in tension accompanying the upward-acting damping force.

Accordingly, damper-tensioner 22A also includes a one-way acting check valve 33 in a second pipe 34, and preferably also a normally-closed control valve 35 in a third pipe 36. The second and third pipes 34, 36 are in parallel with first pipe 24.

As before, when platform 10 heaves up, piston rod 27 strokes out, and check valve 33 is closed, thereby pushing the hydraulic fluid out of cylinder 25 and into reservoir 23 through orifice 32A, which will generate and apply only a downward-acting damping force on the platform.

But now, when platform 10 heaves down, piston rod 27 retracts and check valve 33 opens to permit unrestricted hydraulic fluid flow from reservoir 23 to cylinder 25 through the check valve, which by-passes orifice 32A and no upward-acting damping force will be produced.

With proper design of orifice 32A, the generated damping force will increase the predetermined tension $T_o$ in riser 20 by an amount which is proportional to the velocity of the upward heave of platform 10. This increase in tension is such that the total tension will not exceed the safe axial tension strength of riser 20.

Control valve 35 can selectively deactivate orifice 32A together with check valve 33, when no damping is desired. When normally-closed valve 35 is opened, unrestricted fluid will flow therethrough, and no hydraulic fluid will flow through first and second pipes 24 and 34.

Second Embodiment 22B

Embodiment 22B (FIG. 2) differs from embodiment 22A primarily in that a hydraulic motor 32B replaces throttling orifice 32A. This can be accomplished by opening certain normally-closed valves and by closing certain normally-open valves in pipe 24 and in a parallel pipe 24′. Hydraulic motor 32B FIG. 3A drives a suitable load, such as a water pump (not shown).

As before, when platform 10 heaves up, piston rod 27 strokes out, check valve 33 is closed, thereby pushing the hydraulic fluid out of cylinder 25 and into reservoir 23 through hydraulic motor 32B, which will generate and apply only a downward-acting damping force on the platform.

Conversely, when platform 10 heaves down, piston rod 27 retracts and check valve 33 opens to permit unrestricted hydraulic fluid flow from reservoir 23 to cylinder 25 through the check valve, which by-passes motor 32B and no upward-acting damping force will be produced.

When control valve 35 is opened, unrestricted fluid will flow therethrough, thereby by-passing check valve 33 and hydraulic motor 32B, and no hydraulic fluid will flow through first and second pipes 24 and 34.

Valve 35 can remain open most of the time and closed only when a storm is anticipated, as a precautionary measure against wave energy approaching the platform's resonant period $T_n$.

Third Embodiment 22C

In another embodiment 22C, at least one but preferably four vertical rails 40 (FIGS. 2–10) are secured to the solid frame of platform 10. Each rail 40 preferably has an I-shape in section, which provides a web 41 and inner and outer flanges 42, 43, respectively. A flat bar or fin 44 of suitable metal has a polished surface on both sides and is welded to the inner flange 42 of rail 40.

Carriages 46 are secured to and extend radially outwardly from guide ring 30. Each carriage has sets of guide wheels 48 which ride on the web and the flanges of rail 40.

Rails 40 are movable with production platform 10 relative to guide ring 30, and they restrict the tendency of guide ring 30 to rotate and/or to displace laterally.

Guide ring 30 carries motion slowing down means, generally designated as 50, which are operatively associated between guide ring 30 and rail 40, and are designed to impede the vertical displacements of rail 40 relative to the guide ring.

Guide ring 30 can carry arrays of linear friction brakes, such as mechanical caliper brakes 51, which are adapted to bear against the polished surfaces of fins 44.

Figure 3:
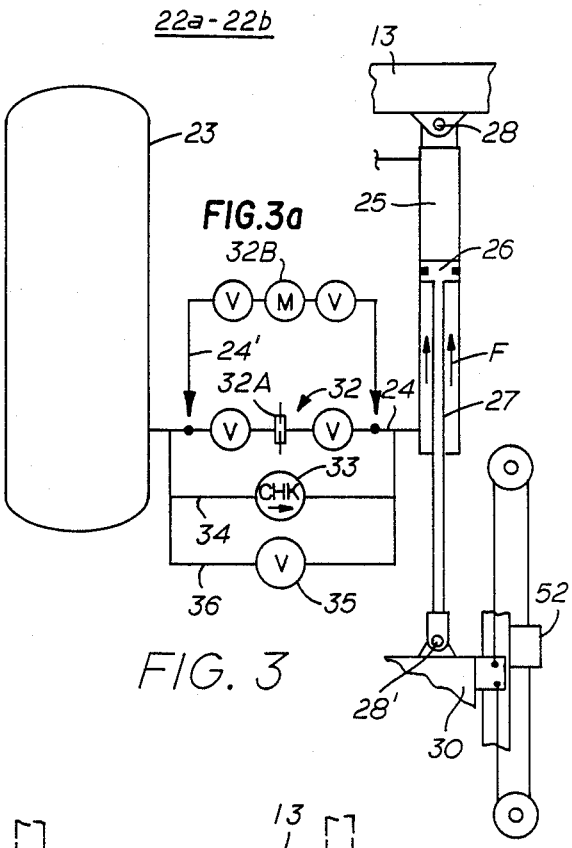

Linear brakes 51 are operated by hydraulic power means (not shown) under the control of an instrumentation control module 52 (FIG. 3). Module 52 is responsive to sensors, including motion and load sensors (not shown), for the purpose of controlling the braking actions of the linear caliper brakes 51.

Brakes 51 are applied against fins 44 only when platform 10 heaves up, thereby slowing down by friction the upward motion of platform 10. The brakes 51 are deactivated when platform 10 heaves-down.

In embodiment 22C, the caliper brakes 51 develop frictional forces that are independent of the platform's displacements relative to the riser. Accordingly, brakes 51 will generate downward-acting, anti-heave forces which are substantially constant and also independent of the heave velocity of platform 10.

Fourth Embodiment 22D

Figure 11:
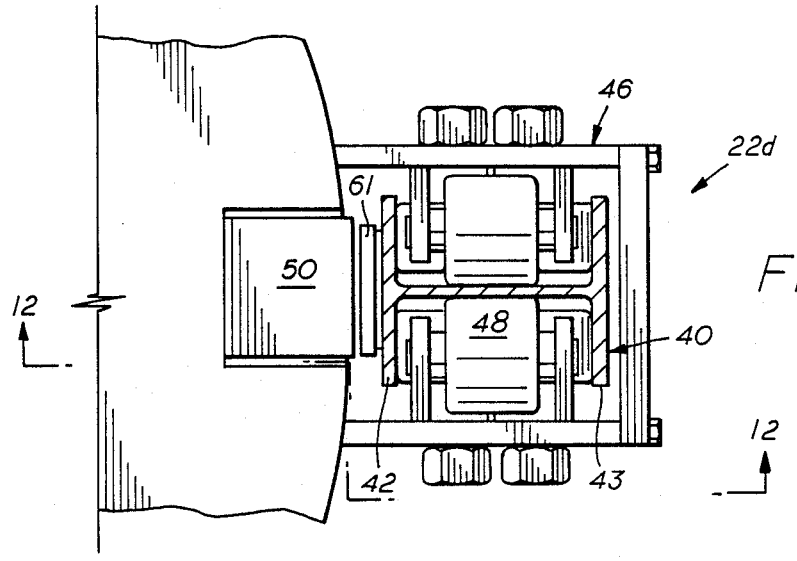
FIG. 11 is a view similar view to FIG. 9 but of the embodiment using eddy current brakes.
Figure 10:
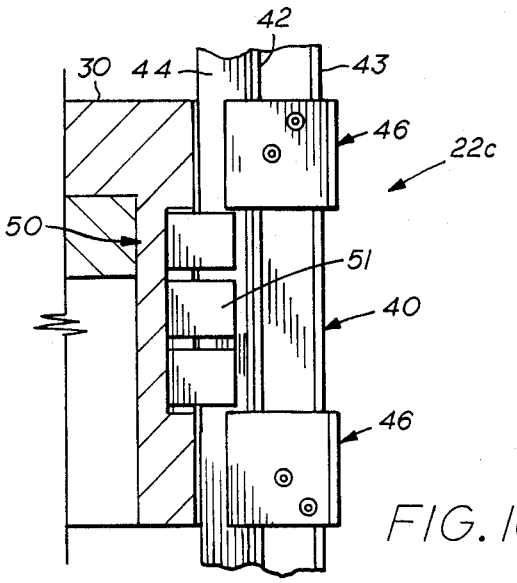
FIG. 10 is a partly sectional view taken on line 10—10 of FIG. 9.
Figure 12:
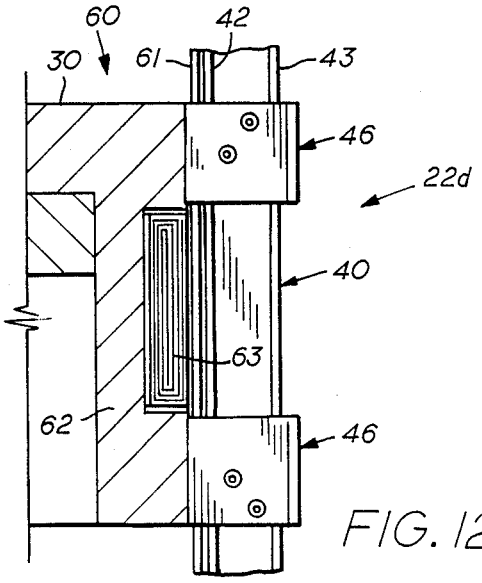
FIG. 12 is a partly sectional view of the eddy current braking system taken on line 12—12 of FIG. 11.

In yet another embodiment 22D (FIGS. 11–12), the motion slowing down means 50 are linear eddy current brakes 60, which are comprised of a long, flat conductive armature 61 that is fastened to the face of inner flange 42 of rail 40.

Linear brakes 60 are operated by current means (not shown) under the control of instrumentation control module 52 (FIG. 3) and its motion and load sensors.

A multiple-winding iron core 62 has an array of eddy current coils 63 and serves as the pole piece which rides vertically up and down on armature 61. As such, brakes 61 depend on a change of magnetic flux, and they develop forces that are dependent on the velocity of the platform's displacements. Accordingly, brakes 60 will generate downward-acting, anti-heave forces which are dependent on the heave velocity of platform 10.

Brakes 60 are applied only when platform 10 heaves up, thereby slowing down electro-magnetically the upward rail motion, and producing downward-acting damping forces on platform 10. The brakes 60 are deactivated when platform 10 heaves-down.

In some of the foregoing embodiments, there is a need to remove heat from the damper-tensioner system 21, which can be conventionally absorbed by platform 10, by heat exchangers, etc.

Figure 13:
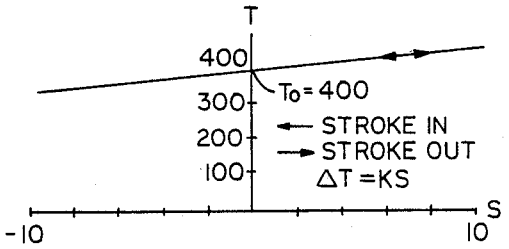
FIG. 13 is a graph depicting the variation in tension applied to the production riser as a function of piston-rod stroke for a damper-tensioner using a reservoir of finite volume.
Figure 8:
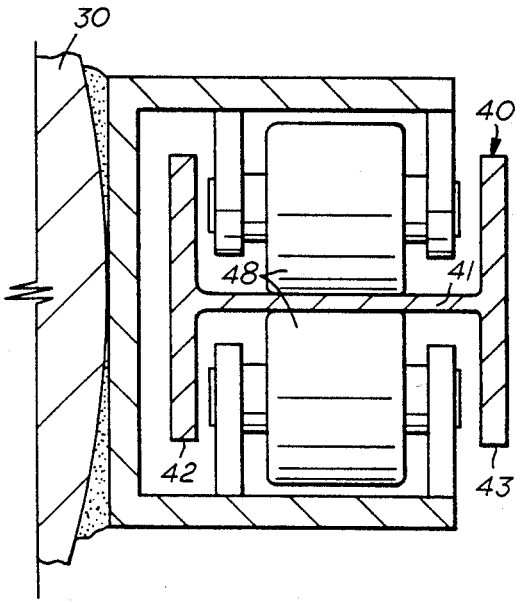

FIG. 13 shows the variation in tension applied to the production riser 20 as a function of stroke of piston for a tensioner system using a reservoir 23 of finite volume. The stroke units on the X-axis are in feet and the tension units on the Y-axis are in kips.

Figure 7:
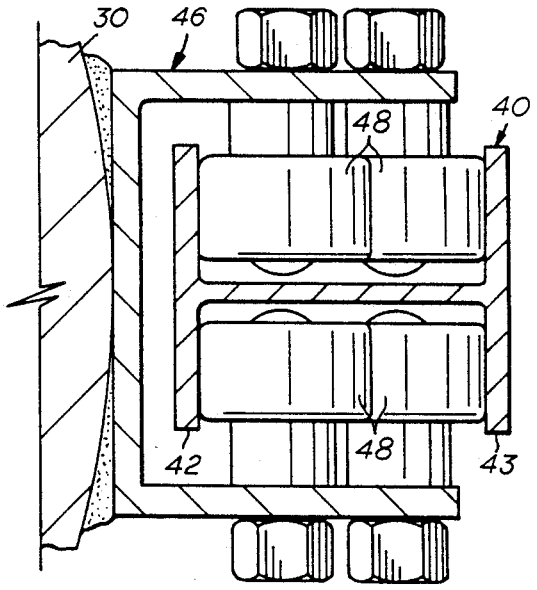
FIGS. 7-8 are partly sectional views, respectively taken on lines 7—7 and 8—8 of FIG. 6.
Figure 14:
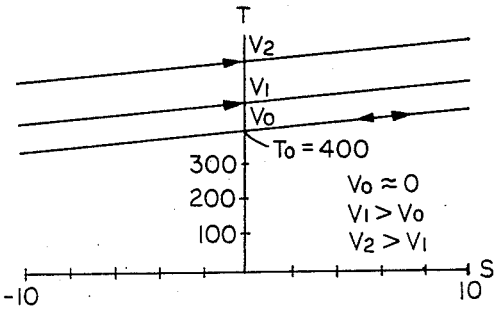
FIG. 14 is a graph similar to FIG. 13 depicting the tension regime of a damper-tensioner for different constant heave velocities only for upward heave.
Figure 9:
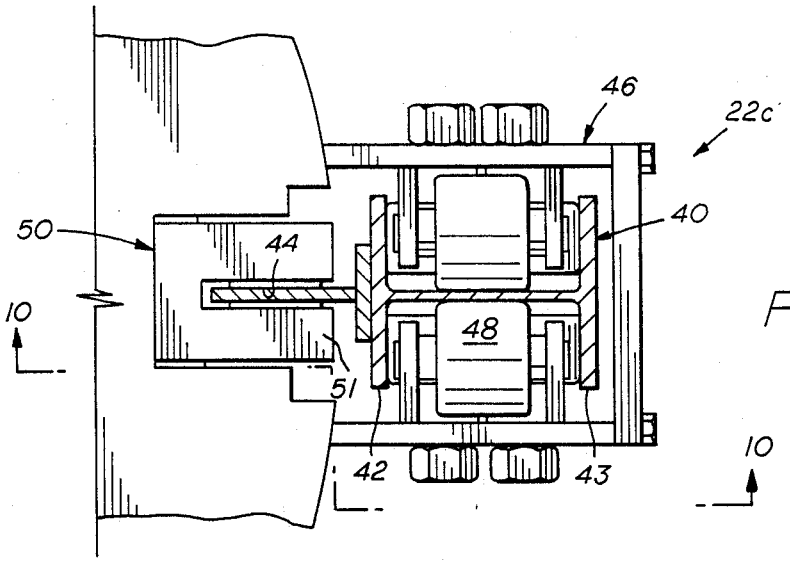
FIG. 9 is a sectional view taken on line 9—9 of FIG. 5 of the embodiment using hydraulic brakes.

FIG. 14 is similar to FIG. 7 and shows the tension regime of a modified damper-tensioner for different constant upward heave velocities.

THEORETICAL CONSIDERATIONS

Platform 10 may be designed so as to experience a low resultant vertical force or heave response to all waves with substantial energy in the design seaway, and to have a natural heave period $T_n$, which is greater than the longest period of the wave with substantial energy in the design seaway.

However, because determination of the worst expected or design seaway is based on historical records and statistics, a certain degree of uncertainty can be expected. Therefore, designers are always faced with a remote but real probability that the longest design wave period may be exceeded during the expected life of the floating platform.

The platform's heave displacement is a particularly serious problem for the rigid production risers 20 which are suspended by tensioners 22 whose hydraulic cylinders have a fixed stroke range. From a mathematical point of view, the tension generated by a hydraulic-pneumatic, damper-tensioner system (assumed to be frictionless) can be expressed as:

$$T(S,ds/dt)=T_o+\Delta T \quad (1)$$

$$\Delta T=kS+c(ds/dt) \quad (2)$$

where:

$T(S,ds/dt)$ = tension versus stroke and stroke velocity $ds/dt$ = stroke velocity $c(ds/dt)$ = damping force component of change in tension $S$ = stroke of the piston in cylinder $kS$ = stiffness force component of change in tension $\Delta T$ = change in tension $k$ = spring constant of the tensioner system $c$ = damping coefficient of the tensioner $T_o$ = tension needed to prevent riser buckling In a conventional tensioner, the mechanical arrangement including piping is purposely designed and sized to provide an unrestricted flow of fluid between cylinder 25 and reservoir 23, thereby reducing to zero the component of change in tension c(ds/dt), which is the damping force of the tensioner system that causes a change in tension proportional to the stroke velocity of piston 26.

The magnitude of the variation in tension due to stroke (i.e., stiffness component Ks) depends on the volume of reservoir 23. For a reservoir 23 of infinite volume, ks would be zero. This volume of reservoir 23 is usually selected to keep the change in tension due to stiffness kS within + (5–15%) of the tension $T_o$, which is the predetermined-tension that is needed to suspend and prevent buckling of production risers 20.

The component of change in tension kS is related to the compression-expansion of the gas in reservoir 23 as the hydraulic fluid is pushed out of and into cylinder 25 and into and out of the reservoir.

The platform's largest expected heave must be within the defined stroke range in order to ensure structural integrity of the stiff production risers 20.

With proper design of hydraulic motor 32B, orifice 32A, or linear eddy current brakes, the generated damping force will increase the tension $T_o$ in riser 20 by a velocity dependent change in tension c(ds/dt).

In all embodiments, the downward-acting forces generated by damper-tensioners 22 are preferably downward-acting, thereby only increasing the tension $T_0$. When platform 10 heaves down, the increased tension in risers 20 returns to its predetermined value $T_o$.

It will be apparent that variations are possible without departing from the scope of the invention.

What is claimed is:

1. A system for damping the heave of a structure floating over the seabed and being subject to oscillatory heave in response to dynamic sea conditions;

at least one framework fixedly secured to said structure;

at least one long member having a bottom end extending from said seabed and a top end;

tensioning means mounted on said framework (1) for suspending said top end of said long member to allow for relative motion between said framework and said top end, and (2) for continuously applying to said top end at least a predetermined minimum tension; and damper means coupled to said tensioning means for increasing the applied tension to said top end of said long member only when said structure heaves up, and thereby exerting only downward-acting damping forces on said floating structure.

2. A system according to claim 1, wherein said damper means include brakes, coupled between said tensioning means and said framework, adapted to develop said damping forces between said framework and said tensioning means; and said damping forces are frictional forces which are independent of the velocity of said platform's upward heave.

3. A system according to claim 2, wherein said brakes are linear, hydraulically-activated brakes, and said damping forces are substantially constant.

4. A system according to claim 1, wherein said damper means include brakes, coupled between said tensioning means and said framework, adapted to develop said damping forces between said framework and said tensioning means; and said damping forces are frictional forces which are dependent on the velocity of said platform's upward heave.

5. A system according to claim 1, wherein said tensioning means include at least one hydraulic cylinder and a pneumatic-hydraulic source for supplying pressurized fluid to said cylinder; and said damper means include hydraulic means, coupled to said cylinder, adapted to develop said damping forces which are dependent on the velocity of said platform's upward heave.

6. A system according to claim 1, wherein said damper means include hydraulic means adapted to develop said damping forces which are independent of the velocity of said platform's upward heave.

7. A system for damping the heave of a structure floating over the seabed and being subject to oscillatory heave in response to dynamic sea conditions;

at least one framework fixedly secured to said structure;

at least one long member having a bottom end secured to said seabed and a top end;

tensioning means mounted on said framework (1) for suspending said top end of said long member to allow for relative motion between said framework and said top end, and (2) for continuously applying to said top end at least a predetermined minimum tension;

damper means coupled to said tensioning means for damping said structure's heave;

said damper means varying the applied tension to said top end in accordance with said structure's heave relative to said long member, thereby exerting corresponding damping forces on said platform in a direction opposite to the direction of its heave; and said damping forces being independent of the velocity of said platform's heave.

8. A system according to claim 7, wherein said damper means include brakes, coupled between said tensioning means and said framework, adapted to develop frictional damping forces between said framework and said tensioning means.

9. A system according to claim 8, wherein said brakes are linear, hydraulically-activated brakes, and said damping forces are substantially constant.

10. A system according to claim 7, wherein said tensioning means include at least one hydraulic cylinder and a pneumatic-hydraulic source for supplying pressurized fluid to said cylinder; and said damper means include hydraulic means adapted to develop said damping forces.

11. A system for damping the heave of a hydrocarbon production platform structure floating over the seabed and being subject to oscillatory heave in response to dynamic sea conditions;

at least one framework fixedly secured to said platform;

at least one production riser having a top end and a bottom end connected to submerged well in the seabed;

a wellhead coupled to said top end;

tensioning means mounted on said framework (1) for suspending said top end to allow for relative motion between said framework and said top end, and (2) for continuously applying to said top end at least a predetermined minimum tension which is sufficient to prevent said riser from buckling under said dynamic sea conditions;

damper means coupled to said tensioning means for damping said structure's heave; and said damper means varying the applied tension to said top end in accordance with said structure's heave relative to said riser, thereby exerting corresponding damping forces on said platform in a direction opposite to the direction of its heave.

12. A system according to claim 11, wherein said platform is a column-stabilized floating hydrocarbon production structure comprising a fully-submersible lower hull, an above-water upper hull, an upper deck, and hollow, buoyant, stabilizing, vertical columns between said upper and lower hulls.

13. A system according to claim 11, wherein said damper means increase the applied tension to said top end of said riser only when said structure heaves up, and thereby exerts only downward-acting damping forces on said platform in accordance with its upward heave relative to said riser.

14. A system according to claim 13, wherein said damper means include brakes, coupled between said tensioning means and said framework, adapted to develop said damping forces between said framework and said tensioning means; and said damping forces are frictional forces which are independent of the velocity of said platform's heave.

15. A system according to claim 14, wherein said brakes are linear, hydraulically-activated brakes, and said damping forces are substantially constant.

16. A system according to claim 13, wherein said damper means include brakes, coupled between said tensioning means and said framework, adapted to develop said damping forces between said framework and said tensioning means; and said damping forces are frictional forces which are dependent on the velocity of said platform's heave.

17. A system according to claim 13, wherein said tensioning means include at least one hydraulic cylinder and a pneumatic-hydraulic source for supplying pressurized fluid to said cylinder; and said damper means include hydraulic means adapted to develop said damping forces which are dependent on the velocity of said platform's upward heave.

18. A system according to claim 13, wherein said tensioning means include at least one hydraulic cylinder and a pneumatic-hydraulic source for supplying pressurized fluid to said cylinder; and said damper means include hydraulic means adapted to develop said damping forces which are independent of the velocity of said platform's heave.

19. A system according to claim 11, wherein said damper means increase the applied tension to said top end of said riser when said structure heaves up, and thereby exert downward-acting damping forces on said platform in accordance with its upward heave relative to said riser; and said damper means decrease the applied tension to said top end of said riser when said structure heaves down, and thereby exert upward-acting damping forces on said floating structure in accordance with its downward heave relative to said riser.

20. A system according to claim 19, wherein said damper means include brakes, coupled between said tensioning means and said framework, adapted to develop said damping forces between said framework and said tensioning means; and said damping forces are frictional forces which are independent of the velocity of said platform's upward heave.

21. A system according to claim 20, wherein said brakes are linear, hydraulically-activated brakes, and said damping forces are substantially constant.

22. A system according to claim 19, wherein said damper means include brakes, coupled between said tensioning means and said framework, adapted to develop said damping forces between said framework and said tensioning means; and said damping forces are frictional forces which are dependent on the velocity of said platform's upward heave.

23. A system according to claim 19, wherein said tensioning means include at least one hydraulic cylinder and a pneumatic-hydraulic source for supplying pressurized fluid to said cylinder; and said damper means include hydraulic means adapted to develop said damping forces which are dependent on the velocity of said platform's heave.

24. A system according to claim 19, wherein said tensioning means include at least one hydraulic cylinder and a pneumatic-hydraulic source for supplying pressurized fluid to said cylinder; and said damper means include hydraulic means adapted to develop said damping forces which are independent of the velocity of said platform's upward heave.

* * * * *